US007703151B2

(12) United States Patent
Blauer et al.

(10) Patent No.: US 7,703,151 B2
(45) Date of Patent: Apr. 27, 2010

(54) CUFF CLOSURE FOR REVERSIBLE GARMENTS

(75) Inventors: Stephen J. Blauer, Lexington, MA (US); Toufic G. Atallah, Reading, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 358 days.

(21) Appl. No.: 11/467,638

(22) Filed: Aug. 28, 2006

(65) Prior Publication Data

US 2008/0047047 A1 Feb. 28, 2008

(51) Int. Cl.
*A41D 27/10* (2006.01)

(52) U.S. Cl. ..... 2/270; 2/160; 2/60; 2/123

(58) Field of Classification Search ..... 2/270, 2/123, 912, 77, 129, 159, 161.4, 60, 59, 160, 2/16, 161.1, 169
See application file for complete search history.

(56) References Cited

U.S. PATENT DOCUMENTS

| | | | | | |
|---|---|---|---|---|---|
| 1,371,841 | A * | 3/1921 | Berkwits | ..... | 2/93 |
| 1,465,625 | A * | 8/1923 | Cragin | ..... | 2/123 |
| 1,482,970 | A * | 2/1924 | Cragin | ..... | 2/123 |
| 1,498,489 | A * | 6/1924 | Steinmetz | ..... | 2/115 |
| 2,174,831 | A * | 10/1939 | Muller | ..... | 112/424 |
| 2,831,196 | A * | 4/1958 | Scheiber | ..... | 2/161.2 |
| 3,296,628 | A * | 1/1967 | Collins | ..... | 2/211 |
| 4,471,495 | A * | 9/1984 | Kruse et al. | ..... | 2/162 |
| 4,530,350 | A * | 7/1985 | Brown et al. | ..... | 602/3 |
| 4,750,218 | A * | 6/1988 | Ziegler | ..... | 2/2.5 |
| 4,800,595 | A * | 1/1989 | Askew | ..... | 2/270 |
| 4,843,650 | A * | 7/1989 | Kangas et al. | ..... | 2/16 |
| 5,054,126 | A * | 10/1991 | Rivkin | ..... | 2/16 |
| 5,073,988 | A * | 12/1991 | Lewis et al. | ..... | 2/162 |
| 5,555,561 | A * | 9/1996 | Plachta et al. | ..... | 2/457 |
| 5,894,602 | A * | 4/1999 | Smith et al. | | |
| 6,076,190 | A * | 6/2000 | Besson | ..... | 2/161.6 |
| 6,374,414 | B1 * | 4/2002 | Collier | ..... | 2/69 |
| 6,715,159 | B2 * | 4/2004 | Cormier | ..... | 2/457 |
| 7,062,792 | B2 * | 6/2006 | Jaunault et al. | ..... | 2/161.6 |
| 7,237,272 | B2 * | 7/2007 | Botcher | ..... | 2/161.6 |
| 2004/0025223 | A1 * | 2/2004 | Jaunault et al. | ..... | 2/159 |

* cited by examiner

*Primary Examiner*—Katherine Moran
*Assistant Examiner*—Richale L Quinn
(74) *Attorney, Agent, or Firm*—Altman & Martin; Steven K Martin

(57) ABSTRACT

A cuff closure comprising a flap having one end attached to the cuff and a free end, a longitudinal slit in the cuff adjacent to the attached end of the flap, a flap fastener component on the flap, a first surface fastener component on the first surface of the cuff that mates with the flap fastener component, and a second surface fastener component on the second surface of said cuff that mates with the flap fastener component. When the first surface is the outside surface, the flap fastener component mates with the first surface fastener component and, when the second surface is the outside surface, the flap fastener component mates with the second surface fastener component.

9 Claims, 3 Drawing Sheets

CUFF CLOSURE FOR REVERSIBLE GARMENTS

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to clothing, more particularly, to closures for arm and leg openings of reversible garments.

2. Description of the Related Art

Reversible garments are well-known articles of clothing. Some reversible garments are made for use where it is desirable to close the cuff tight around the arm or leg in order to, for example, keep in warmth or keep out rain. It is also well-known that a cuff can be tightened around the arm or leg by the use of a fabric flap sewn to the outside of the cuff that pulled around the cuff and secured with a temporary closure such as a microhook-microloop fastener. Until now, putting such a cuff closure on a reversible garments has meant a tradeoff: either only one side of the garment could be closed or both sides could be closed, but one of the flap in the inside of the cuff would possibly cause discomfort or irritation to the wearer.

BRIEF SUMMARY OF THE INVENTION

An object of the present invention is to provide a cuff closure that can be used on both sides of a reversible garment while eliminating the shortcomings of the prior art.

The cuff closure of the present invention includes a flexible flap extending from the cuff, a slit in the cuff adjacent to the flap, a fastener on the flap, a mating fastener on the first surface of the cuff, and a mating fastener on the second surface of the cuff.

If the cuff is composed of a single layer fabric, one end of the flap is attached to one of the cuff surfaces, leaving the other end of the flap extending away from the cuff. If the cuff is composed of two or more fabric layers, the one end of the flap can be attached to one of the cuff surfaces or between layers. The slit extends through all the fabric layers adjacent to the flap and is wide enough for the flap to fit through. A fastener component is attached to the flap and fastener components that mate with the flap fastener component are attached to both surfaces of the cuff. Contemplated fasteners include mating microhook and microloop patches and snaps.

Regardless of which cuff surface is outside, the flap is pulled through the slit so that it is on the outside, the cuff is snugged around the wearer's arm or leg, and the flap fastener component is attached to the surface fastener component on the outside of the cuff.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
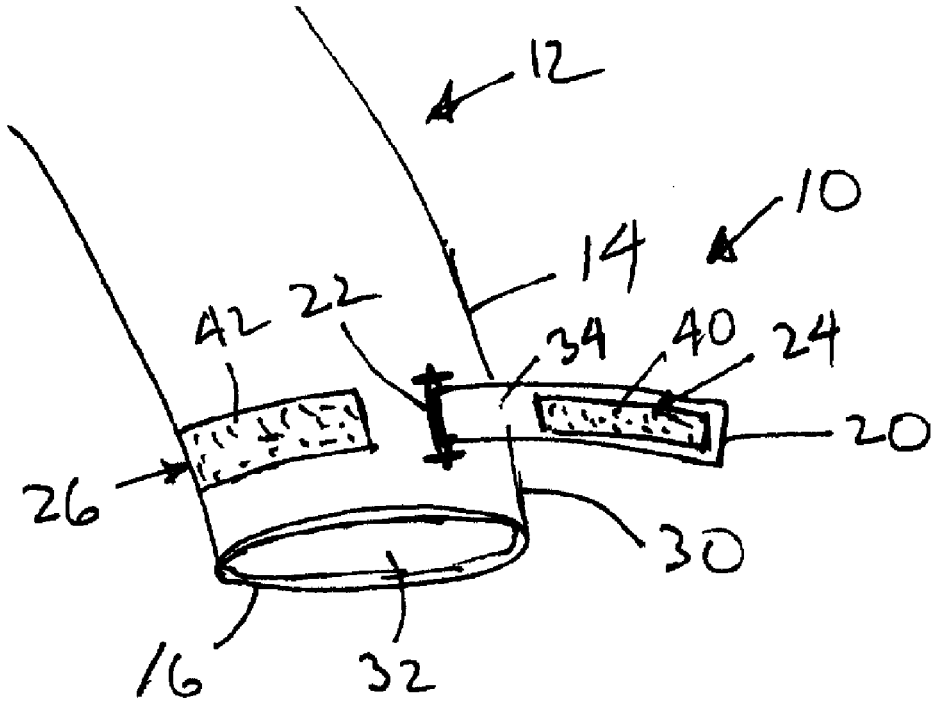
FIG. 1 is a perspective view of the cuff closure of the present invention showing microhook/microloop fasteners.

The cuff closure 10 of the present invention can be used with any reversible garment 12 that has an opening for an arm or leg. Examples include shirts, jackets, rainwear, pants, environment suits, gloves, boots, etc. The remainder of the present specification uses a sleeve as an example, but this example is not intended to be limiting. In the present specification and claims, the opening, regardless of its form, structure, or location, is referred to as a cuff. For convenience, the two sides of the cuff are referred to as the first surface and the second surface. Since the garment is reversible, in one configuration, the first surface is the outside surface and the second surface is the inside surface. When the garment is reversed, the second surface becomes the outside surface and the first surface becomes the inside surface.

Referring to the figures, the basic cuff closure 10 includes a flexible flap 20 extending from the cuff 14, a longitudinal slit 22 in the cuff 14, a temporary fastener component 24 on the flap 20, a temporary fastener component 26 on the first surface 30 of the cuff 14 that mates with the flap fastener component 24, and a temporary fastener component 28 on the second surface 32 of the cuff 14 that mates with the flap fastener component 24.

Figure 2:
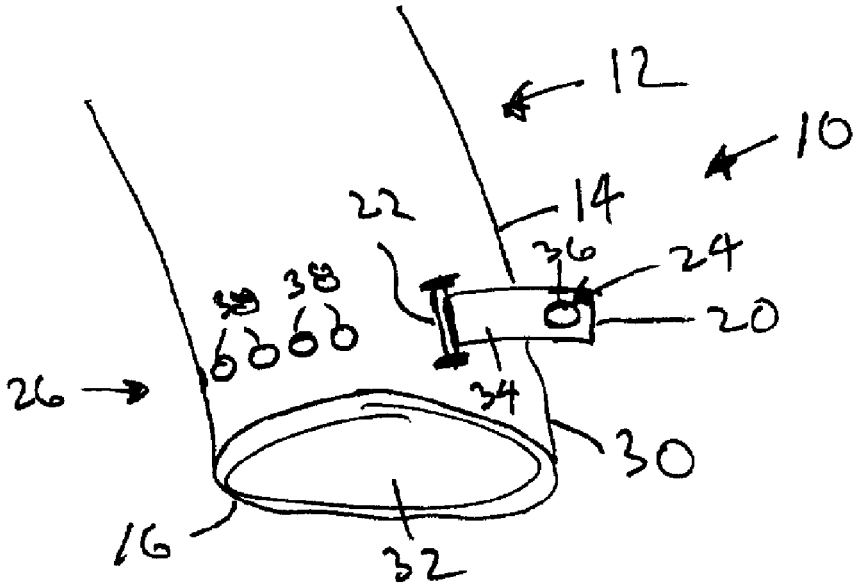
FIG. 2 is a perspective view of the cuff closure of the present invention showing snap fasteners.
Figure 3:
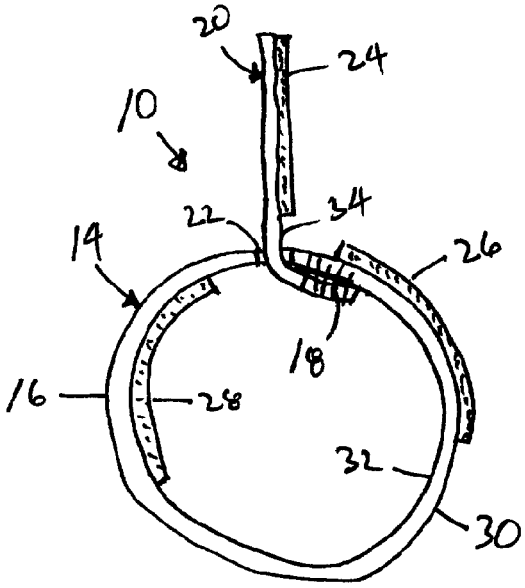
FIG. 3 is a cross-sectional drawing of one embodiment of the cuff closure of FIG. 1.

FIGS. 2 and 3 show how the cuff closure 10 is embodied on a garment 12 with a single fabric layer 16 or where multiple layers are laminated together over their entire surfaces. One end of the flap 20 is attached to the second (inside) surface 32 of the cuff 14, leaving the other end of the flap 20 extending away from the cuff 14. It is apparent that, when the garment 12 is turned inside out for reverse wear, the flap 20 will be still be attached to the second surface 32, but is now the outside surface of the cuff 14. The attachment typically takes the form of stitching, as at 18, but can be any form of attachment that is adequate to secure the flap 20 to the cuff fabric, such as an adhesive. The present invention also contemplates that the flap 20 is not a separate item attached to the cuff 14, but is an integral extension of the cuff fabric.

Figure 4:
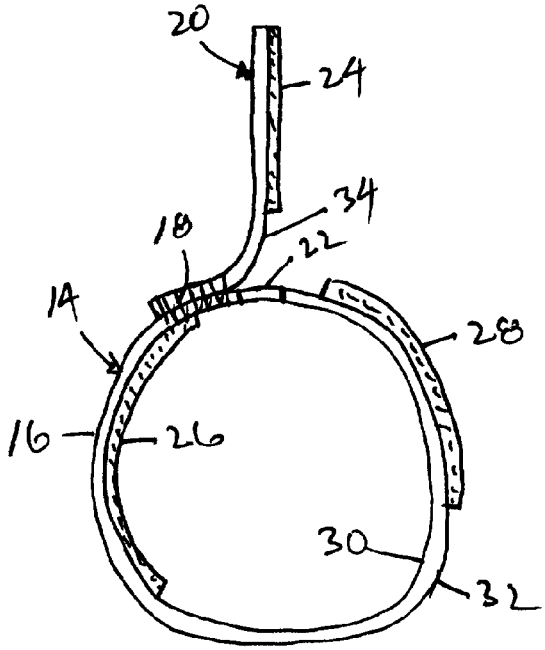
FIG. 4 is the embodiment of FIG. 3 after the cuff has been reversed.
Figure 5:
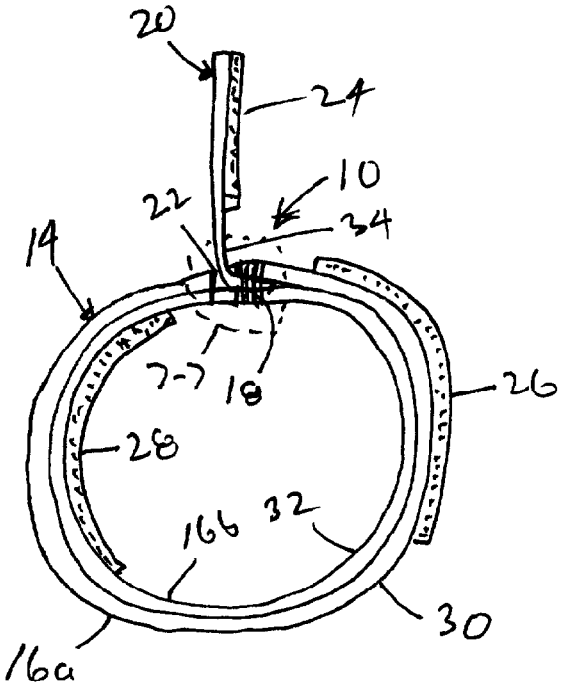
FIG. 5 is a cross-sectional drawing of another embodiment of the cuff closure of FIG. 1.
Figure 6:
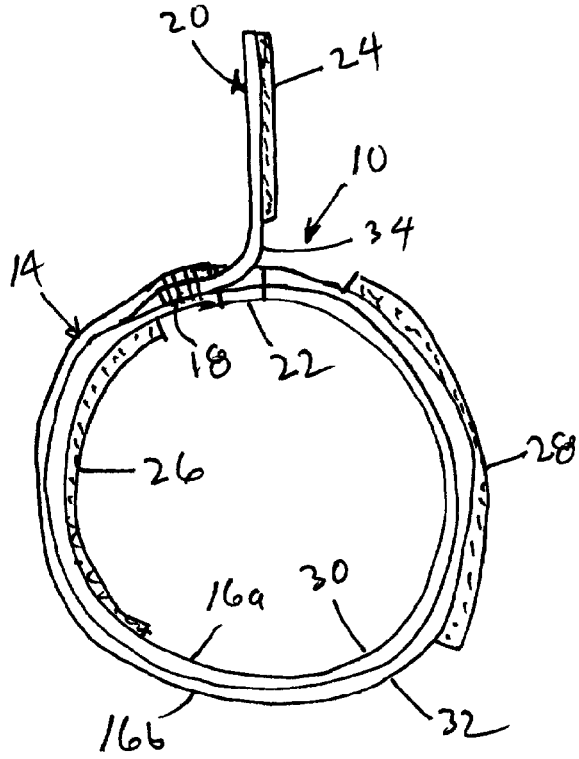
FIG. 6 is the embodiment of FIG. 5 after the cuff has been reversed.
Figure 7:
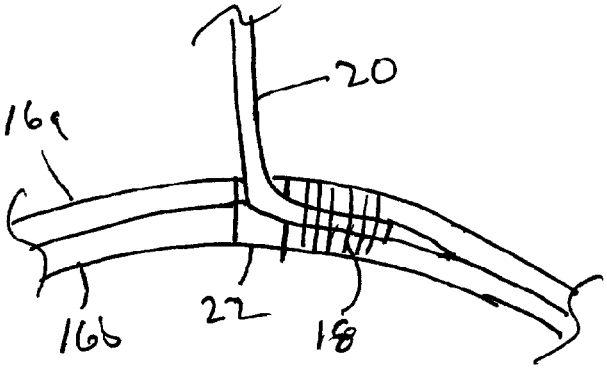
FIG. 7 is a detail of the slit region 7-7 in the embodiment of FIG. 5.

FIGS. 4-6 show how the cuff closure 10 is embodied on a garment 12 with two or more fabric layers 16*a*, 16*b*. As shown in detail in FIG. 6, one end of the flap 20 is attached between the two fabric layers 16*a*, 16*b*, leaving the other end of the flap 20 extending away from the cuff 14. The attachment typically takes the form of stitching, as at 18, but can be any form of attachment that is adequate to secure the flap 20 between the fabric layers 16*a*, 16*b*, such as an adhesive. The present invention also contemplates that the flap 20 is not a separate item attached to the cuff 14, but is an integral extension of one or more of the fabric layers 16*a*, 16*b*.

The slit 22 extends through all the fabric layers 16 and is located in the cuff 14 adjacent to, that is, at or near to, where the flap 20 extends from the cuff 14. As can be seen in FIG. 1, the slit 22 is at least as long as the flap 20 is wide so that the flap 20 fits through the slit 22, as in FIGS. 2, 4, and 5. In ways well-known in the art, the slit 22 is generally reinforced so that is does not easily tear when subjected to normal stresses of use.

A component 24 of the fastener is attached to one side 34 of the flap 20. A mating component 26 of the flap fastener component 24 is attached to the first surface 30 of the cuff 14 and another mating component 28 of the flap fastener component 24 is attached to the second surface 32 of the cuff 14. One contemplated fastener is mating microfastener patches, comprised of mating microhook and microloop patches 40, 42, as shown in FIG. 1.

Another contemplated fastener is a snap, shown in FIG. 2. With snaps, the flap fastener component 24 is a single component 36 and the surface fastener components 26, 28 are each composed of a row of components 38 that mate with flap fastener component 24. A row of fastener components 38 is necessary so that the size of the cuff 14 is adjustable.

The present invention contemplates that other similarly functional fasteners can be used, such as buttons or removable adhesives.

Whether the flap fastener component 24 or the surface fastener components 26, 28 are male or female does not affect the operation of the present invention. Generally, the flap fastener component 24 will be male and the surface fastener components 26, 28 will be female because the surface fastener components 26, 28 come into contact with the wearer. The female microloop component has a much softer feel than the male microhook component, and the snap female component does not have a protruding part like the male component.

To use the present invention, when the garment 12 is turned inside out or reversed, the flap 20 is pulled through the slit 22 so that it is on the outside, as in FIG. 1. The closure 10 is then used like similar prior art closures. The cuff 14 is snugged around the wearer's arm or leg, generally by folding the loose cuff fabric, and the flap fastener component 24 is attached to the surface fastener component 26, 28 on the outside of the cuff 12.

Thus it has been shown and described a cuff closure which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

We claim:

1. A closure for a cuff, said cuff having a first surface and a second surface, said cuff being reversible such that either said first surface is an outside surface and said second surface is an inside surface or said second surface is said outside surface and said first surface is said inside surface, said closure comprising:

(a) a flap having an attached end attached to said cuff and a free end extending away from said cuff;

(b) a longitudinal through slit in said cuff located adjacent to said attached end of said flap and adapted to permit said flap to extend therethrough;

(c) a flap fastener component on said flap;

(d) a first surface fastener component on said first surface of said cuff, said first surface fastener component adapted to mate with said flap fastener component; and (e) a second surface fastener component on said second surface of said cuff and, said second surface fastener component adapted to mate with said flap fastener component;

(f) whereby, when said first surface is the outside surface, said flap fastener component mates with said first surface fastener component such that said flap is outside said first surface, and, when said second surface is the outside surface, said flap fastener component mates with said second surface fastener component such that said flap is outside said second surface.

2. The closure of claim 1 wherein said flap has a width at said attached end and said slit has a length that is at least said flap width.

3. The closure of claim 1 wherein said fastener components are microhook and microloop patches.

4. The closure of claim 1 wherein said flap fastener component is a snap component and said surface fastener components are series of snap components that mate with said flap fastener component.

5. The closure of claim 1 wherein said flap is attached to said first surface.

6. The closure of claim 1 wherein said cuff is comprised of a plurality of fabric layers and said flap is attached to said cuff between said fabric layers.

7. A closure for a cuff, said cuff having a first surface and a second surface, said cuff being reversible such that either said first surface is an outside surface and said second surface is an inside surface or said second surface is said outside surface and said first surface is said inside surface, said closure comprising:

(a) a flap having an attached end attached to said cuff and a free end extending away from said cuff, said flap having a width at said attached end;

(b) a longitudinal through slit in said cuff located adjacent to said attached end of said flap, said slit having a length that is at least said flap width, wherein said flap can extend through said slit;

(c) a flap microhook/microloop patch on said flap;

(d) a first surface microhook/microloop patch on said first surface of said cuff, said first surface patch adapted to mate with said flap patch; and (e) a second surface microhook/microloop patch on said second surface of said cuff, said second surface patch adapted to mate with said flap patch;

(f) whereby, when said first surface is the outside surface, said flap patch mates with said first surface patch such that said flap is outside said first surface, and, when said second surface is the outside surface, said flap patch mates with said second surface patch such that said flap is outside said second surface.

8. The closure of claim 7 wherein said flap is attached to said first surface.

9. The closure of claim 7 wherein said cuff is comprised of a plurality of fabric layers and said flap is attached to said cuff between said fabric layers.

* * * * *